US006020547A

United States Patent [19]

Chen

[11] Patent Number: 6,020,547

[45] Date of Patent: Feb. 1, 2000

[54] SNARE MOUNTING AND TENSION ADJUSTING ARRANGEMENT

[75] Inventor: Erh-Chiang Chen, Taichung Hsien, Taiwan

[73] Assignee: Tay E. Co., Ltd., Taichung Hsien, Taiwan

[21] Appl. No.: 09/208,749

[22] Filed: Dec. 10, 1998

[30] Foreign Application Priority Data

Feb. 13, 1998 [TW] Taiwan ..... 87202028

[51] Int. Cl.[7] ..... G10D 13/02

[52] U.S. Cl. ..... 84/415; 84/411 R; 121/231.9

[58] Field of Search ..... 84/415, 416, 417, 84/411 R, 418, 413, 421, 327; 121/231.9, 231.91

[56] References Cited

U.S. PATENT DOCUMENTS

| | | | |
|---|---|---|---|
| 521,379 | 6/1894 | Lougee | 84/415 |
| 1,011,533 | 12/1911 | Wanamaker | 84/415 |
| 1,615,699 | 1/1927 | Hiers | 84/415 |
| 1,619,046 | 3/1927 | Ward | 84/415 |
| 1,724,888 | 8/1929 | Strupe | 84/415 |
| 3,113,481 | 12/1963 | Thompson | 84/415 |
| 3,865,003 | 2/1975 | Della-Porta | 84/411 |
| 3,981,220 | 9/1976 | Clark | 84/415 |
| 4,095,505 | 6/1978 | Hoey et al. | 84/416 |
| 4,339,982 | 7/1982 | Hoshino | 84/415 |
| 4,520,709 | 6/1985 | Kester, Jr. | 84/415 |
| 5,557,053 | 9/1996 | Nickel | 84/415 |
| 5,616,875 | 4/1997 | Lombardi | 84/415 |
| 5,841,049 | 11/1998 | Strawn | 84/411 R |

FOREIGN PATENT DOCUMENTS 383740 1/1965 Switzerland .

*Primary Examiner*—Robert E. Nappi
*Assistant Examiner*—Wesley Scott Ashton
*Attorney, Agent, or Firm*—Bacon & Thomas

[57] ABSTRACT

A snare mounting and tension adjusting arrangement includes a tension adjustment unit and a snare holder unit fastened to the peripheral wall of a snare drum to hold a snare under the snare head of the snare drum, wherein the tension adjustment unit includes a locating frame fixed to the snare drum at one side, a slide coupled to a rail at the locating frame, an adjusting screw bolt mounted in a through hole at the locating frame and threaded into a screw hole at the slide and rotated to lift/lower the slide along the rail in adjusting the tension of the snare, and a locking lever pivoted to the slide and controlled to lock the slide.

2 Claims, 7 Drawing Sheets

SNARE MOUNTING AND TENSION ADJUSTING ARRANGEMENT

BACKGROUND OF THE INVENTION

The present invention relates to a snare drum, and more specifically to an arrangement for mounting and adjusting the tension of the snare of a snare drum.

A regular snare drum comprises two snare holders at two opposite sides of the peripheral wall thereof to hold a snare under its snare head. The tension of the snare greatly affects the quality of sound produced by the snare drum. FIG. 1 shows a snare holder for this purpose. The snare holder comprises a mounting plate fixedly fastened to the peripheral wall of the snare drum at one side, and a clamping plate fastened to the mounting plate to hold one end of the snare. Before installation, mounting holes must be made in the peripheral wall of the snare drum so that the mounting plate can be fixedly secured to the peripheral wall of the snare drum in position. Further, when adjusting the tension of the snare, the clamping plate must be loosened from the mounting plate. This tension adjustment procedure is complicated.

SUMMARY OF THE INVENTION

The present invention provides a snare mounting and tension adjusting arrangement which eliminates the aforesaid drawbacks. According to the preferred embodiment of the present invention, the snare mounting and tension adjusting arrangement comprises a tension adjustment unit and a snare holder unit fastened to the peripheral wall of a snare drum to hold a snare under the snare head of the snare drum, wherein the tension adjustment unit includes a locating frame fixed to the snare drum at one side, a slide coupled to a rail at the locating frame, and an adjusting screw bolt mounted in a through hole at the locating frame and threaded into a screw hole at the slide. The adjusting screw bolt is rotated to lift/lower the slide along the rail, and a locking lever is pivoted to the slide and controlled to lock the slide. When the screw bolt is rotated in one direction, the slide is lifted, and the tension of the snare is stretched. When the screw bolt is rotated in the reversed direction, the slide is lowered, and the tension of the snare is loosened.

DETAILED DESCRIPTION OF THE PREFERRED

Figure 1:
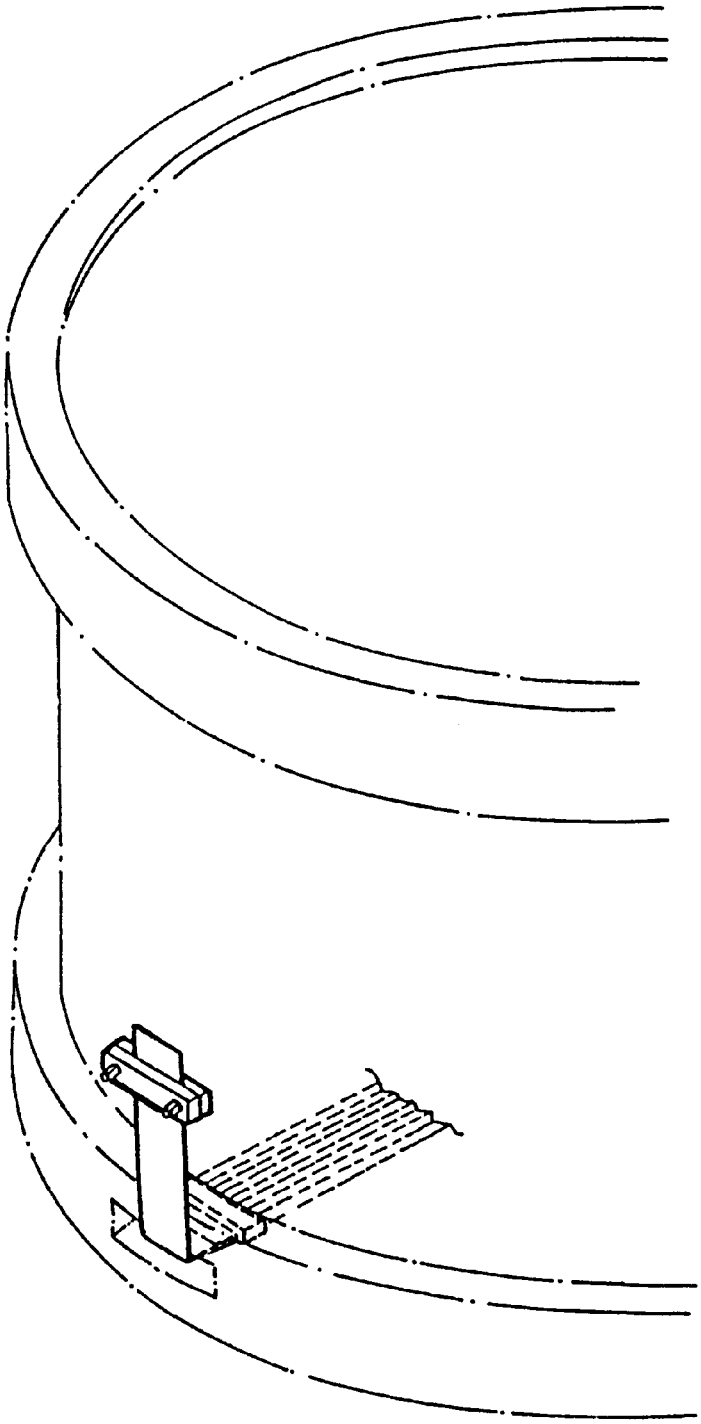
Fig·1 PRIOR ART
FIG. 1 illustrates a snare holder installed in a snare drum according to the prior art.
Figure 2:
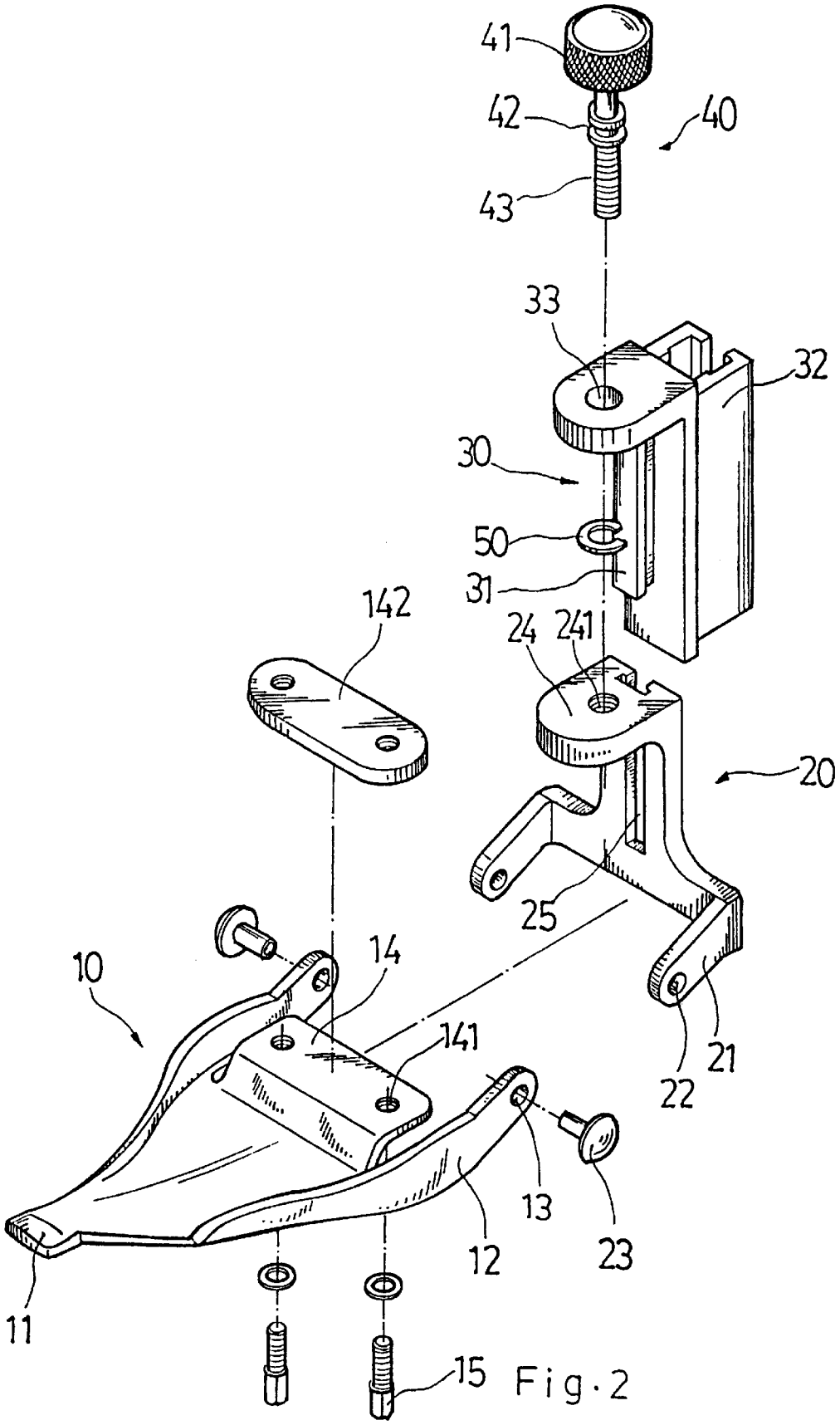
FIG. 2 is an exploded view of a tension adjustment unit according to the present invention.

Referring to Figures from 2 through 4, the invention comprises a tension adjustment unit and a snare holder unit.

The tension adjustment unit is comprised of a locking lever 10, a slide 20, a locating frame 30, and an adjusting screw bolt 40. The locking lever 10 comprises a finger strip 11 at the rear side of the substantially Y-shaped body thereof, two forwardly extended upright side walls 12 bilaterally disposed at the front side, the upright side walls 12 each having a pivot hole 13 at the front side, a transverse snare seat 14 suspended between the upright side walls 12, the transverse snare seat 14 having two screw holes 141, and a clamping plate 142 fastened to the screw holes 141 of the transverse snare seat 14 by screws 15 to secure one end 44 of a snare 4. The slide 20 comprises a vertical sliding slot 25 in the flat vertical body thereof, two horizontal coupling arms 21 bilaterally forwardly extended from the bottom side of the flat vertical body, the coupling arms 21 each having a pivot hole 22 at the end, and a horizontal head 24 forwardly extended from the top side of the flat vertical body, the horizontal head 24 having a screw hole 241 at the center. The pivot holes 22 of the coupling arms 21 of the slide 20 are respectively coupled to the pivot holes 13 in the upright side walls 12 of the locking lever 10 by a respective pivot pin 23. The locating frame 30 comprises a vertical rail 31 of T-shaped cross section coupled to the vertical sliding slot 25, a vertical through hole 33 at the top side corresponding to the screw hole 241 at the horizontal head 24 of the slide 20, and a hollow mounting frame 32 including arms 321 that extend towards peripheral wall of the snare drum and transverse extensions 322 connected by a cross-bar 323 to form slots arranged to accomodate bolts 51 for fastening the mounting frame directly to the peripheral wall of the snare drum. The adjusting screw bolt 40 comprises a threaded stem 43, a head 41 at one end of the threaded stem 43, and an annular groove 42 around the periphery of the threaded stem 43 near the head 41. The adjusting screw bolt 40 is mounted in the through hole 33 at the locating frame 30, and threaded into the screw hole 241 at the head 24 of the slide 20. Further a C-clamp 50 is fastened to the annular groove 42 to secure the adjusting screw bolt 40 in place. When the adjusting screw bolt 40 is rotated, the slide 20 is forced to move upwards/downwards along the vertical rail 31 of the locating frame 30.

Figure 5:
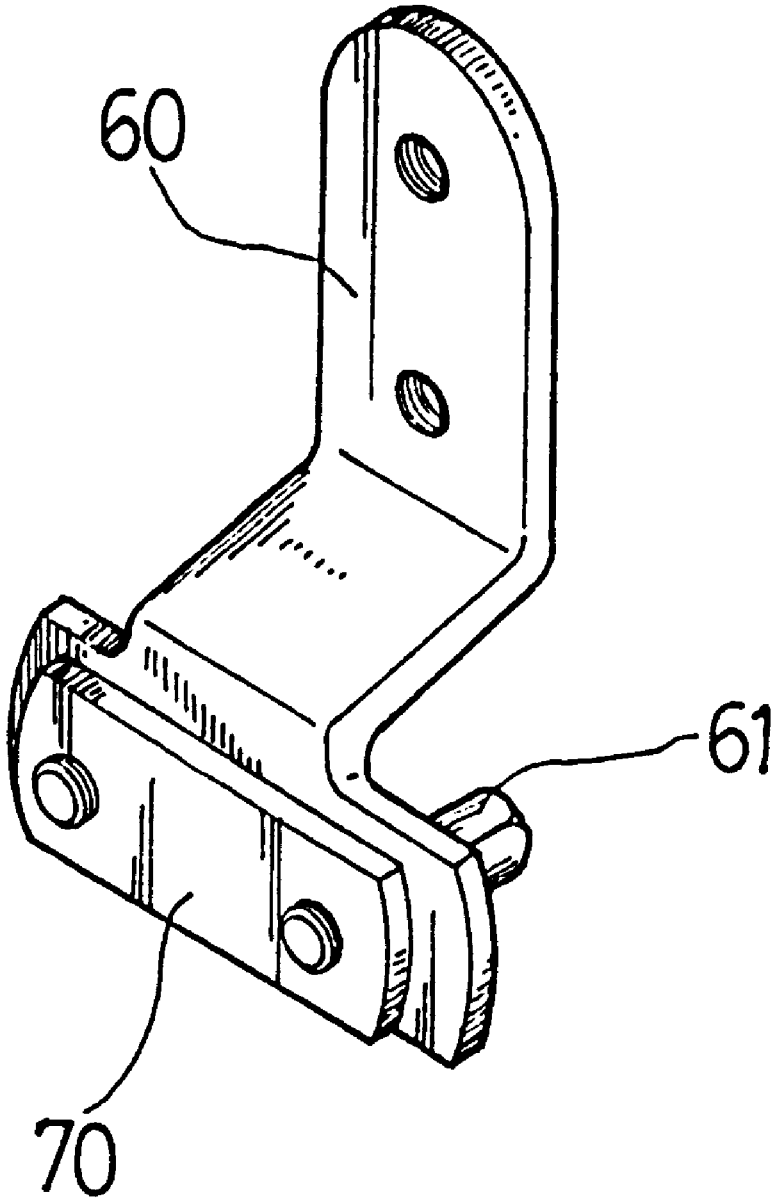
FIG. 5 is a perspective view assembly view of a snare holder unit according to the present invention.

Referring to FIG. 5, the snare holder unit comprises a mounting plate 60 fastened to the peripheral wall of the snare drum by screws 61, and a clamping plate 70 fastened to the mounting plate 60 to secure the other end of the snare 4.

Figure 3:
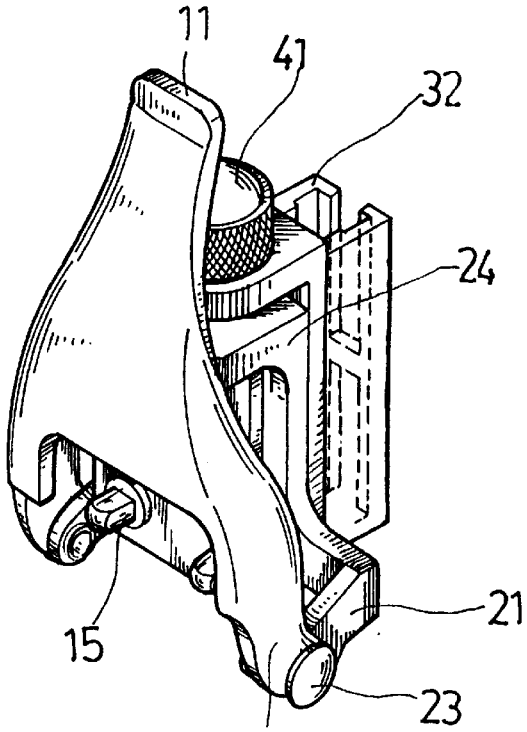
FIG. 3 is a perspective assembly view of the tension adjustment unit shown in FIG. 2, showing the locking lever turned to the locking position.
Figure 4:
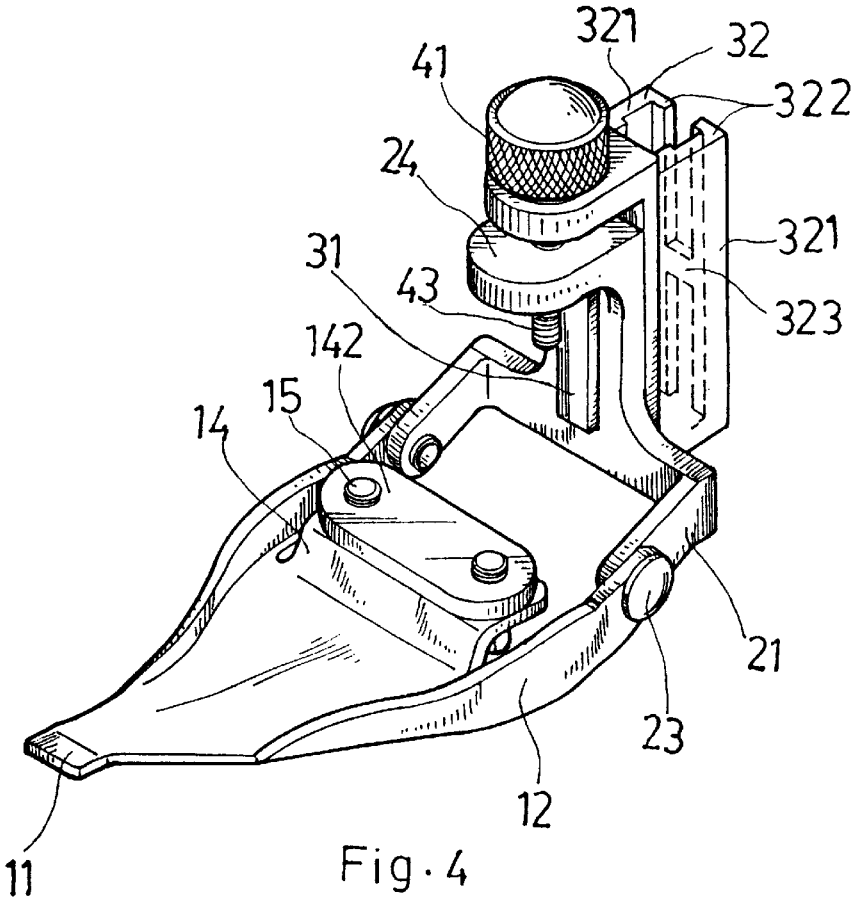
FIG. 4 is similar to FIG. 3 but showing the locking lever turned to the unlocking position.
Figure 6:
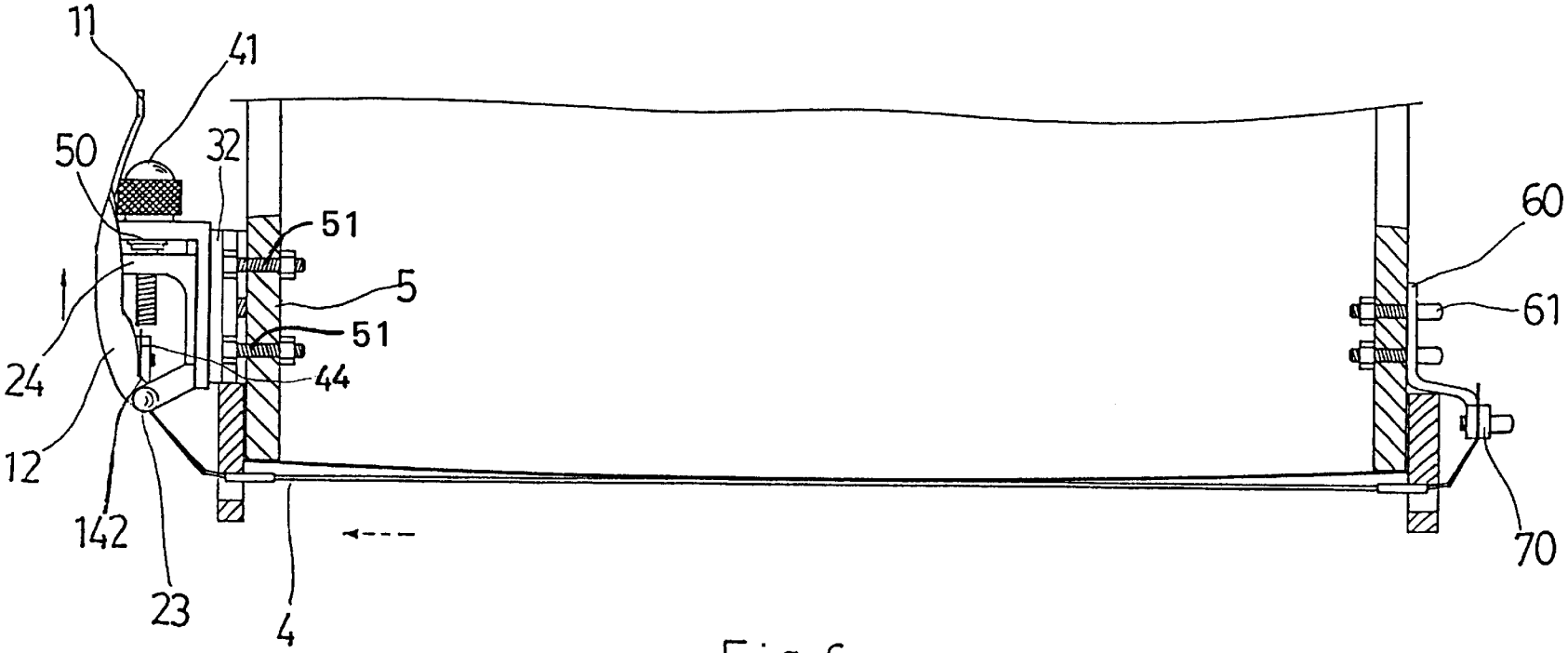
FIG. 6 is schematic drawing showing the adjustment of the tension adjustment unit in one direction.
Figure 7:
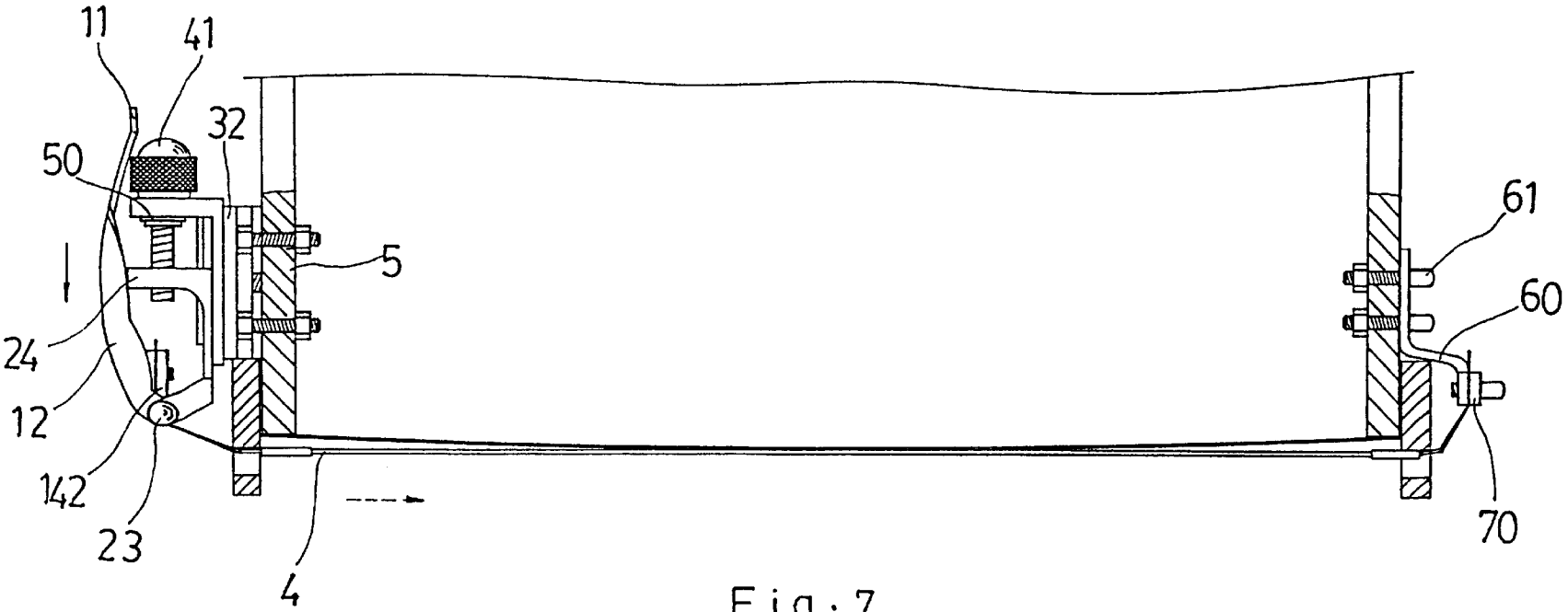
FIG. 7 is similar to FIG. 6 but showing the tension adjustment unit adjusted in the reversed direction.
Figure 8:
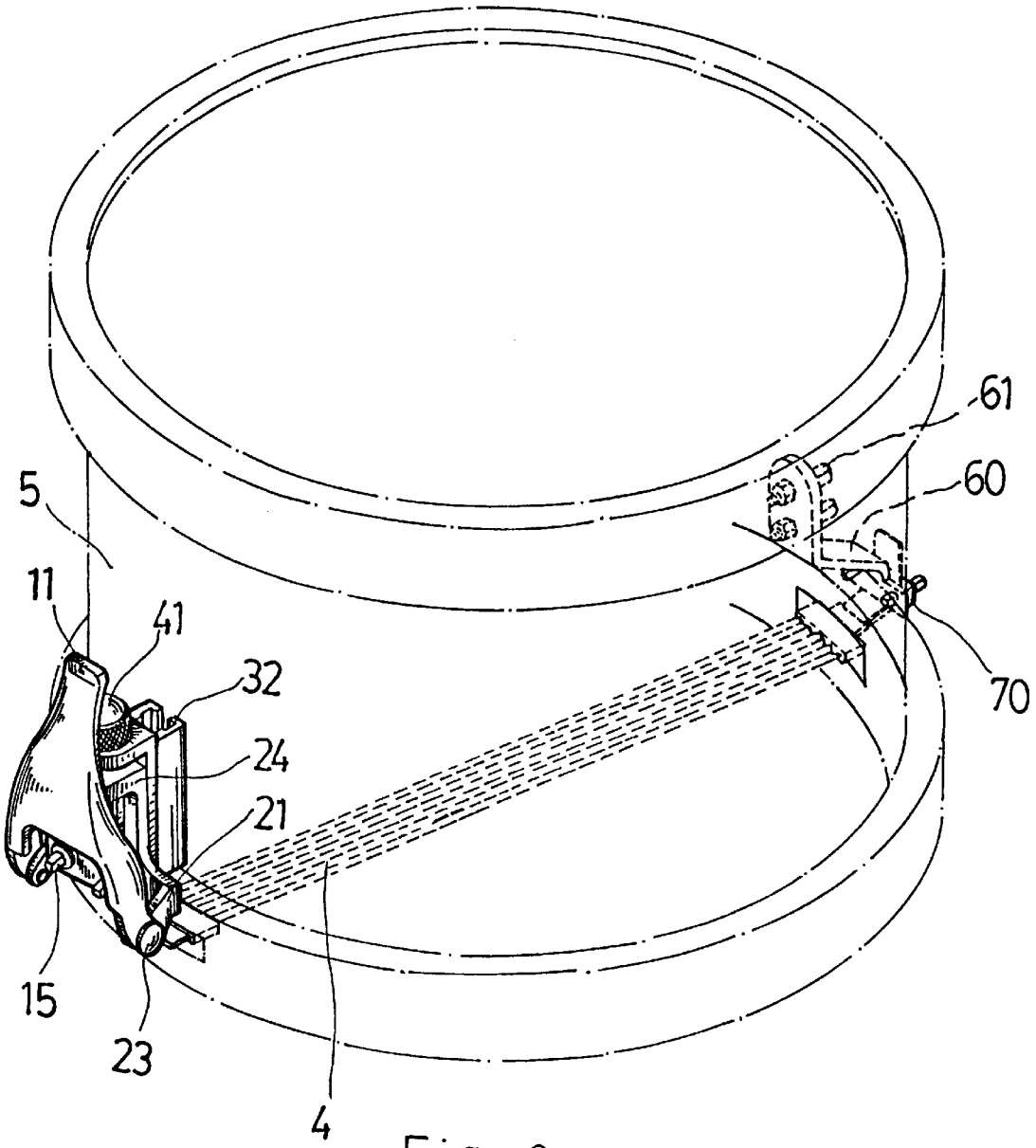
FIG. 8 is an installed view of the present invention.

Referring to FIGS. 6 and 7, the tension adjustment unit and the snare holder unit are respectively fastened to the peripheral wall 5 of the snare drum at two opposite sides, and then the snare 4 is connected between the tension adjustment unit and the snare holder unit under the snare head of the snare drum. For a higher tune, the adjustment screw bolt 40 is rotated in one direction to lift the slide 20. When the slide 20 is lifted, the locking lever 10 is moved upwards with the slide 20, thereby causing the snare to be stretched. After adjustment, the locking lever 10 is turned upwards from the unlocking position (see FIG. 4) to the locking position (see FIGS. 3, 6 and 7) to lock the snare 4. On the contrary, the adjustment screw bolt 40 can be rotated in the reversed direction to lower the slide 20 and the locking lever 10 thereby reducing the tension of the snare 4 to achieve a lower tune.

What is claimed is:

1. A snare mounting and tension adjusting arrangement comprising a tension adjustment unit and a snare holder unit fastened to a peripheral wall of a snare drum to hold a snare under the snare head of the snare drum and controlled to adjust a tension of the snare, said tension adjustment unit comprising:

a locating frame, said locating frame comprising a vertical rail having a T-shaped cross section, a vertical through hole at a top side of the vertical rail, and a hollow mounting frame at a back side of the vertical rail , said hollow mounting frame including arms that extend towards the peripheral wall of the snare drum and transverse extensions connected by a cross-bar to form slots arranged to accommodate bolts that directly fasten the mounting frame to the peripheral wall of the snare drum at one side;

a slide coupled to said locating frame and moved vertically along said vertical rail, said slide comprising a flat vertical body, a vertical sliding slot situated in said flat vertical body and coupled to said vertical rail, two horizontal coupling arms bilaterally forwardly extended from said flat vertical body at a bottom side, the coupling arms each having a free end and a pivot hole at the free end, and a horizontal head forwardly extended from said flat vertical body at a top side, said horizontal head having a screw hole at the center;

an adjusting bolt mounted in the through hole of said locating frame and threaded into the screw hole at the horizontal head of said slide, wherein said adjusting bolt is arranged to be rotated to move said slide vertically along said rail of said locating frame, said adjusting screw bolt comprising a head stopped above said locating frame, a threaded stem threaded into the screw hole at the horizontal head of said slide, and an annular groove around the periphery of said threaded stem;

a C-clamp fastened to the annular groove of the threaded stem of said adjusting screw bolt to secure said adjusting screw bolt to said locating frame; and a locking lever pivoted to said slide and controlled to stretch said snare, said locking lever comprising a Y-shaped body, a finger strip at a rear side of said Y-shaped body thereof, two forwardly extended upright side walls bilaterally disposed at a front side of said Y-shaped body and respectively pivoted relative to said slide by a respective pivot pin positioned in the pivot holes of the coupling arms of said slide, a transverse snare seat suspended between said upright side walls, and a clamping plate fastened to said transverse snare seat by screws to secure one end of said snare to said locking lever.

2. The snare mounting and tension adjusting arrangement of claim 1 wherein said snare holder unit comprises a mounting plate fastened to the peripheral wall of the snare drum by screws, and a clamping plate fastened to the mounting plate of said snare holder unit to secure one end of said snare.

* * * * *